US011110465B2

(12) United States Patent
Doppstadt

(10) Patent No.: US 11,110,465 B2
(45) Date of Patent: Sep. 7, 2021

(54) CRUSHING DEVICE WITH A COMB SYSTEM

(71) Applicant: Doppstadt Familienholding GmbH, Velbert (DE)

(72) Inventor: Ferdinand Doppstadt, Velbert (DE)

(73) Assignee: Doppstadt Familienholding GmbH, Velbert (DE)

( * ) Notice: Subject to any disclaimer, the term of this patent is extended or adjusted under 35 U.S.C. 154(b) by 146 days.

(21) Appl. No.: 16/492,759

(22) PCT Filed: May 7, 2018

(86) PCT No.: PCT/EP2018/000240

§ 371 (c)(1),
(2) Date: Sep. 10, 2019

(87) PCT Pub. No.: WO2018/206143

PCT Pub. Date: Nov. 15, 2018

(65) Prior Publication Data

US 2020/0070177 A1 Mar. 5, 2020

(30) Foreign Application Priority Data

May 8, 2017 (DE) ..... 20 2017 002 387.3
Feb. 16, 2018 (DE) ..... 20 2018 000 803.6

(51) Int. Cl.
*B02C 18/18* (2006.01)
*B02C 18/14* (2006.01)
(Continued)

(52) U.S. Cl.
CPC ..... *B02C 18/145* (2013.01); *B02C 18/18* (2013.01); *B02C 23/16* (2013.01);
(Continued)

(58) Field of Classification Search
CPC ..... B02C 18/145; B02C 18/18; B02C 18/16; B02C 18/14; B02C 23/16; B02C 2018/188
See application file for complete search history.

(56) References Cited

U.S. PATENT DOCUMENTS 2,261,090 A 10/1941 Lind
4,836,457 A * 6/1989 Greiner ..... B02C 13/284 241/73

(Continued)

FOREIGN PATENT DOCUMENTS

DE 202015003527 U1 3/2016
SU 1444158 A1 12/1988

OTHER PUBLICATIONS

International Preliminary Report on Patentability for International Application No. PCT/EP2018/000240, dated Nov. 21, 2019.

(Continued)

*Primary Examiner* — Faye Francis
(74) *Attorney, Agent, or Firm* — Jason H. Vick; Sheridan Ross, PC

(57) ABSTRACT

One aspect relates to a crushing device with a comb system, wherein the crushing device includes at least one crushing roller rotatably mounted in a machine frame with at least one crushing tool arranged thereon, wherein the crushing device comprises at least one counter blade which cooperates with the crushing tool, wherein the comb system includes at least one base comb on which the at least one counter blade is arranged and on which at least one screening element can be arranged as a component of a screening device. The screening device during use at least partly encloses the crushing roller and the screening element is spring-mounted with a suspension on the base comb. The suspension includes an end position limit.

18 Claims, 4 Drawing Sheets

(51) Int. Cl.
*B02C 23/16* (2006.01)
*B02C 18/16* (2006.01)

(52) U.S. Cl.
CPC .. *B02C 2018/164* (2013.01); *B02C 2018/188* (2013.01); *B02C 2023/165* (2013.01)

(56) References Cited

U.S. PATENT DOCUMENTS

| | | | | |
|---|---|---|---|---|
| 5,472,147 | A * | 12/1995 | Doppstadt | B02C 13/09 241/101.74 |
| 7,909,277 | B2 * | 3/2011 | Doppstadt | B02C 18/18 241/73 |
| 7,992,812 | B2 * | 8/2011 | Doppstadt | B02C 18/18 241/73 |
| 9,573,137 | B2 * | 2/2017 | Van der Galien | B02C 23/16 |
| 10,099,224 | B2 * | 10/2018 | Peterson | B02C 18/145 |
| 2009/0121058 | A1 * | 5/2009 | Doppstadt | B02C 18/145 241/88.2 |
| 2010/0252670 | A1 * | 10/2010 | Kitaguchi | B02C 18/145 241/277 |
| 2017/0361331 | A1 | 12/2017 | Doppstadt et al. | |

OTHER PUBLICATIONS

International Search Report for International Application No. PCT/EP2018/000240, dated Sep. 17, 2018.
Written Opinion for International Application No. PCT/EP2018/000240, dated Sep. 17, 2018.

* cited by examiner

CRUSHING DEVICE WITH A COMB SYSTEM

CROSS REFERENCE TO RELATED APPLICATIONS

This application is a national stage application Under 35 U.S.C. 371 of PCT Application No. PCT/EP2018/000240 having an international filing date of 7 May 2018 which designated the United States, which PCT application claimed the benefit of German Application No. 20 2017 002 387.3 filed 8 May 2017 and German Application No. 20 2018 000 803.6 filed 16 Feb. 2018, each of which are incorporated herein by reference in their entirety.

SUMMARY

The invention relates to a crushing device with a comb system, wherein the crushing device consists of at least one crushing roller rotatably mounted in a machine frame with at least one crushing tool arranged thereon, wherein the crushing device comprises at least one counter blade, which cooperates with the crushing tool, wherein the comb system comprises at least one base comb, on which the at least one counter blade is arranged and on which at least one screening element can be arranged as a component of a screening device, wherein the screening device at least partly encloses the crushing roller during intended use and the screening element is spring-mounted with a suspension on the base comb.

Such crushing devices are rather well known in the prior art. Such a crushing device is also known from the earlier utility model DE 20 2015 003 527 of the applicant. The spring-loaded mounting of the screening elements was described here. Thanks to this movable, spring-loaded mounting, it was already possible to reduce overloading of the devices by clogging even to the point of standstill and breakage of the tools.

One drawback which has been encountered during the intended use of the above-described devices is that the compression springs are compressed by the process strain even to the point of a "block pressure." This can also lead to contact with the spring wire coils, for example. This results in random contact points leading to local overload and which may cause a breakage of the spring wire coils. This is tantamount to a total failure of the individual subassembly. A further drawback is that the compression spring becomes deformed into an S shape during lateral yielding movements. This also may lead to a breakage of the spring wire and/or the spring wire coils.

Starting from this prior art, the problem which the invention proposes to solve is to propose a crushing device no longer having at least one of the above-described drawbacks.

The object of the invention is solved by a crushing device having a comb system, wherein the crushing device consists of at least one crushing roller rotatably mounted in a machine frame with at least one crushing tool arranged thereon, wherein the crushing device comprises at least one counter blade which cooperates with the crushing tool, wherein the comb system comprises at least one base comb on which the at least one counter blade is arranged and on which at least one screening element can be arranged as a component of a screening device, wherein the screening device during intended use at least partly encloses the crushing roller and the screening element is spring-mounted with a suspension on the base comb, characterized in that the suspension comprises an end position limit. This end position limit for example may be formed from an elastic material. Of course, it is also possible to provide a spring with an opposing spring action.

The object of the invention is also solved by a crushing device having a comb system, wherein the crushing device consists of at least one crushing roller rotatably mounted in a machine frame with at least one crushing tool arranged thereon, wherein the crushing device comprises at least one counter blade, which cooperates with the crushing tool, wherein the comb system comprises at least one base comb, on which the at least one counter blade is arranged and on which at least one screening element can be arranged as a component of a screening device, wherein the screening device during intended use at least partly encloses the crushing roller and the screening element is spring-mounted with a suspension on the base comb, characterized in that the suspension is formed from at least one compression spring configured as a spiral spring, in the core of which at least one cylindrical body made from an elastic material is arranged.

Thanks to the two solutions described above, an overloading of the compression springs is avoided by the end position limit and/or the cylindrical body made from an elastic material preventing the yielding movements and/or pointlike contacts between spring coils from occurring. Thus, for example, in the clear internal region of the compression spring there is installed a cylindrical body which consists of an elastic material. Elastomers preferably used for this have the desirable attribute that they have a progressive characteristic curve of pressure and distance. Now, this material can prevent the spring coils from striking against each other. Because the spring undergoes a spherical broadening when placed under load on account of the compression of the elastic material, the above-described S-shaped yielding deformation is prevented from occurring. Thus, the two described drawbacks of the prior art are eliminated by the solution proposed according to the invention. The down times will be even further reduced and the fault susceptibility on the whole will be decreased.

Thanks to a suitable match between the outer diameter of the elastomer element and the clear inner diameter of the spiral compression spring, a specific nonlinear graduated suspension characteristic can also be created. This is another major benefit resulting from the use of the solution according to the invention.

The basic design of the device of the prior art has been changed by the solution according to the invention in such a way that there is no longer any central through bolt for the fastening. Instead, the design has now been chosen such that the spiral compression spring has end disks which in turn possess fastening features at the ends. In this way, the spring and further functional components are held in position in the unloaded state.

One advantageous modification of the solution according to the invention calls for the elastic material being an elastomer with a progressive characteristic curve of pressure and distance. The material chosen for the cylindrical elastomer body has a hardness of 60 to 120 Shore. A material having the hardness ranking of 90 Shore A is preferred. Such a material best fulfills the above-described desirable properties by means of which the benefits according to the invention can be achieved.

One advantageous modification of the solution according to the invention, as has been described above, is characterized in that the cylindrical elastomer body has a central through bore by means of which a further parameter for adjusting a specific suspension behavior is provided. In this way, an elastic yielding of the elastomer body may occur under a corresponding loading in the middle. A deformation and damage by a corresponding loading is specifically avoided in this way. The suspension behavior can be specifically influenced by changing the diameter of the bore. If one selects the diameter of the bore to be larger, the spring behavior becomes softer, while with a smaller bore the suspension becomes more rigid.

It is advantageous for the cylindrical body to be formed according to one modification of the invention as an elastomer spring element whose outer diameter corresponds to the inner diameter and/or the core diameter of the compression spring. This enhances the stability of the spring assembly. At the same time, the desired effects of the limiting of the spring distance and/or the damping of pressure under loading are achieved.

A crushing device as previously described is characterized in that the cylindrical body extends across only a portion of the internal spring distance. However, the invention also calls for the cylindrical body to extend across the entire internal spring distance of the compression spring. The above-described effects and/or desired properties can be achieved with both solutions by an appropriate adjustment.

Of course, it is also proposed according to the invention that the cylindrical body acts as an end position limit and/or end position buffer for the compression spring. The solution so described constitutes the preferred variant of the solution according to the invention.

The crushing device according to the invention is also characterized by design variants which have already proven themselves in the prior art, which in combination with the above-described solution proposals lead to further improvements in the crushing device. Thus, it is also proposed that a mounting as a part of the bearing is provided as a gimballed bearing on the base comb, on which the screening element is pivot-mounted, preferably pivoting in two different directions, e.g., pivoting horizontal and vertical orientation. In particular, the bearing pivoting in two different directions means that the screening elements can yield not only to larger vertically-oriented disturbing elements, but also to horizontal ones. Of course, this even further reduces the fault susceptibility of the device.

According to one modification of the above-described solution, it is proposed that the mounting is configured at a right angle and shaped as a fork at least on the side facing the screening element or angled on one side, in order to enclose the screening element. This solution in terms of design is totally different from the solution known in the prior art and it leads to a further improvement in the spring behavior and in particular a decrease of the fault susceptibility.

A further aspect of this modification is indicated by provision of a locking piece to secure the screening element, wherein the locking piece can be fastened by means of a fastening element on the mounting.

It is also advantageous for the compression spring to have end disks with fastening features at the ends. This is likewise part of the altered design solution in regard to the mounting.

It has also proven to be advantageous to provide the suspension spaced apart from and parallel to the mounting. In this way, sufficient room can be provided in the device for the arrangement of the spring.

A further aspect of the crushing device according to the invention is indicated by provision of a preferably interchangeable seat on the base comb, on which the mounting, the suspension and the screening element are interchangeably arranged. In this way, the entire seat, possibly also with mounted screening elements, can be dismounted together from the base comb and/or mounted again. Hence, entire subassemblies can be kept on hand, which can then be replaced accordingly in the stipulated instance. One may also provide different configurations of subassemblies for repair purposes. An individual mounting and/or an individual replacement of damaged screening elements is also made possible in this way.

The crushing device according to the invention is also characterized according to another modification in that the suspension comprises an adjusting device by means of which the preloading force of the spring and/or the attack angle of the screening element can be adjusted.

Of course, it is also provided according to the invention that a plurality of screening elements are arranged on the seat and the screening elements are provided as a collectively mountable and/or dismountable assembly with the seat.

It is furthermore advantageous for the screening element as a comb extension element to be adapted to and/or follow the radius of the crushing roller.

One advantageous modification of the invention proposes that the distance of the screening element from the crushing roller is adjustable. In this way, it is possible for example to establish the size of the crushed material, and/or to establish how large the material can be which is fed back to the crushing process once more.

It has proven to be especially advantageous for the crushing device according to the invention to be configured such that a pivoting device is provided by means of which the base comb can pivot about an axis. This enables the distance of the crushing tools from the counter blades to be changed, which is necessary if one would like to change the size of the crushed material. At the same time, one can move the base comb together with the counter blades and the screening elements toward the crushing roller and away from it again. Besides the desired distance adjustment, this attribute of the device may also be used for cleaning the roll gaps between the teeth if too much material is stuck there. This may occur, for example, with very moist material. Of course, this will hinder the crushing process as a whole, which can be eliminated by the above-described attribute of the device.

A further aspect of the invention is to be seen in that a toothed rack is provided, on which the counter blade is arranged individually or as an assembly with a plurality of counter blades.

The invention proposes that the crushing device and/or the comb system comprises at least the base comb, the toothed rack having counter blades and/or alternation teeth, and the screening device with the seat and screening elements as comb extension elements.

The screening device of the crushing device according to the invention is advantageously shaped as a basket. Here, individual screening elements form the basket.

The crushing device according to the invention is further characterized in that the position of the crushing roller and the screening device in the device is oriented substantially horizontally and/or the screening device encloses the crushing roller in the lower region in its erect position.

BRIEF DESCRIPTION OF THE DRAWINGS

The invention shall now be described with the aid of exemplary embodiments.

DETAILED DESCRIPTION

Figure 1A:
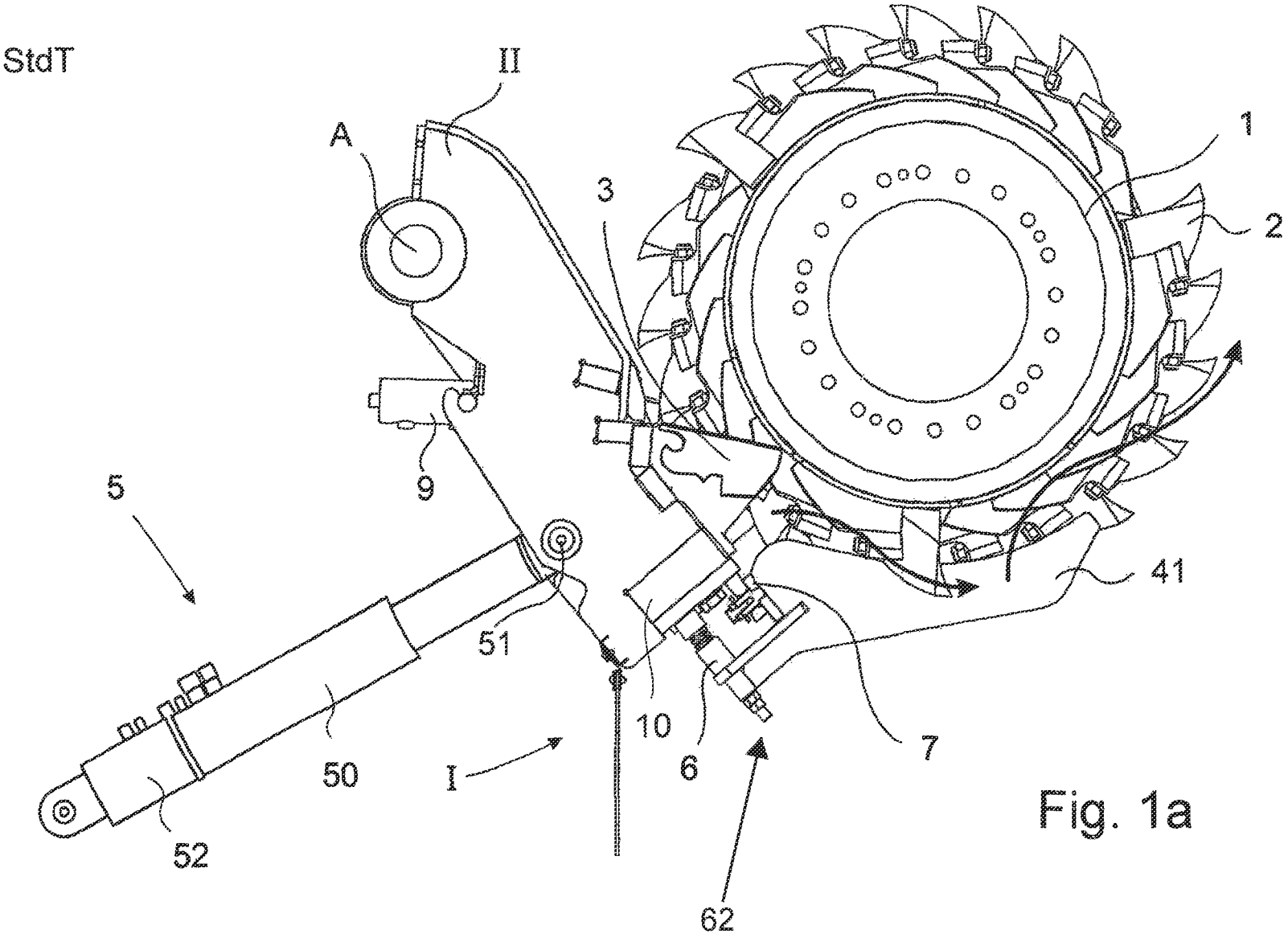
FIGS. 1*a*-1*b* show various views of details of the crushing device of the prior art.

One embodiment of the crushing device according to the invention shall be described below with the aid of the figures. It is pointed out that the drawn representation is only one example of a crushing device according to the invention, and should in no way be construed in limiting manner. In the drawings, the same features are given the same reference numbers, so that all the drawings can be described as a complex.

Figure 1B:
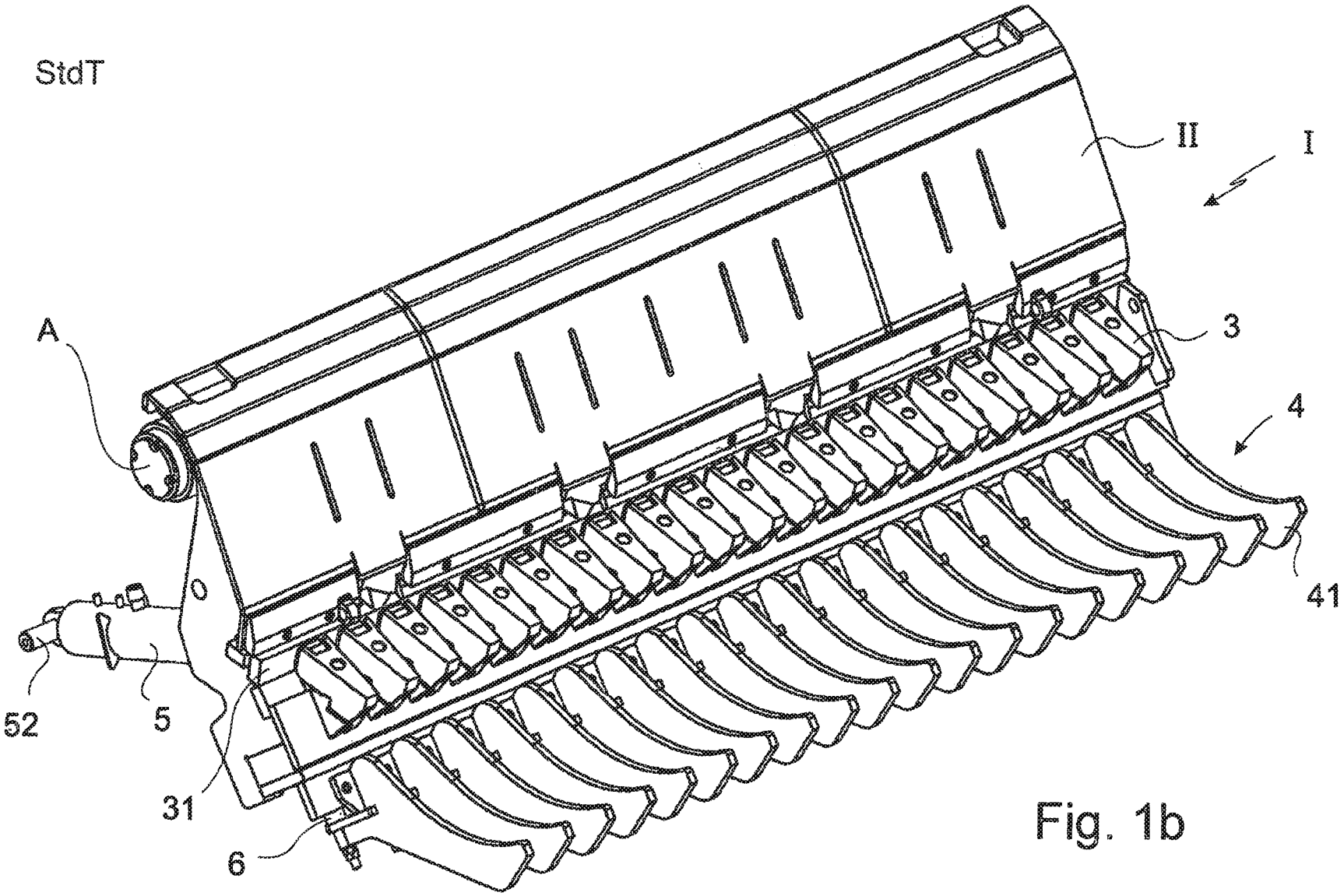

FIGS. 1*a* and 1*b* show a side view and a three-dimensional representation of the base comb II of the crushing device of the prior art, provided with screening elements 41. The crushing roller 1 is arranged in a frame (not shown) similar as the base comb II with elements arranged on it. The comb system according to the invention is indicated schematically by an arrow and the reference number 1. This consists of a base comb II, on which counter blades 3 and the screening elements 41 of the screening device 4 are arranged. The base comb II can pivot about an axis A. The pivoting movement is realized by a pivoting device 5 formed from a hydraulic cylinder 50, which is secured in the device by a base comb axis 51 and a housing axis 52. The housing axis is provided on the frame (not shown) of the crushing device. The screening elements 41 are secured on a mounting 7, which is part of the bearing, to the base comb II. The spring-loaded bearing is accomplished by the suspension 6, which like the mounting 7 is arranged on a preferably replaceable seat 10. The mounting 7 and the suspension 6 are provided parallel to and spaced apart from each other, which means that with the aid of an adjusting device 62 it is possible to change both the preloading force of the spring 61 and the attack angle $\alpha$ of the screening elements 41. This is a major advantage, since in this way it is possible to respond appropriately to different material being crushed, i.e., the angle and optionally the preloading force can be adjusted. A compression spring is provided as the spring 61, being arranged at least partly in a spring sleeve 63. The mounting 7 of the screening elements 41 may be designed as a gimballed mount. The pivoting device 5 comprises yet another hydraulic cylinder 9, but this works in opposition to the hydraulic cylinder 50. Using the hydraulic cylinder 9, the distance from the base comb II to the crushing roller 1 is set at an end stop. On the base comb II there is provided a toothed rack 31, on which the counter blades 3 are provided individually or as a subassembly with a plurality of counter blades 3. Further, a wear plate 32 is provided between the toothed rack 31 and the counter blade 3 fashioned as a comb tooth, which prevents the entire base comb II from having to be replaced in event of wear. One will then replace only the wear plate. The counter blades 3 are secured to the base comb by means of a latch 10, which can also preferably be hydraulic in design.

Figure 2A:
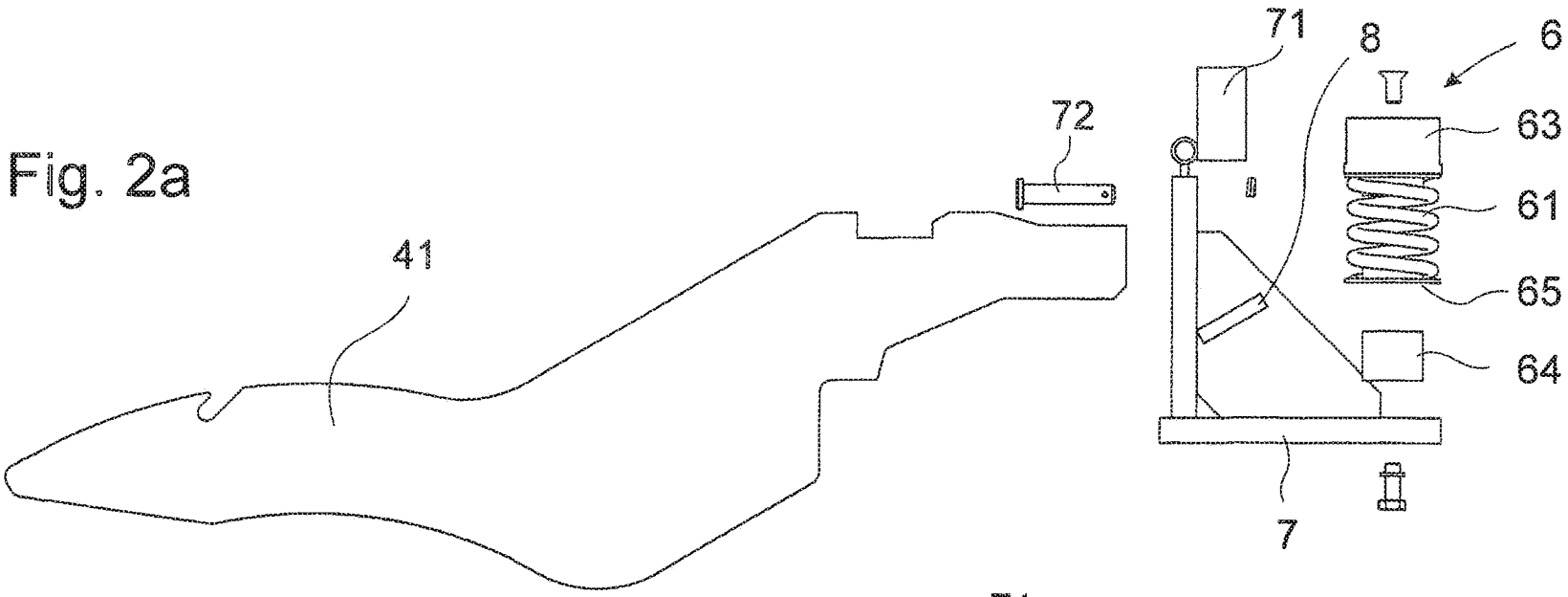
FIGS. 2*a*-2*b* show representations of the suspension of the screening element according to the invention as an exploded drawing and in the assembled state.
Figure 2B:
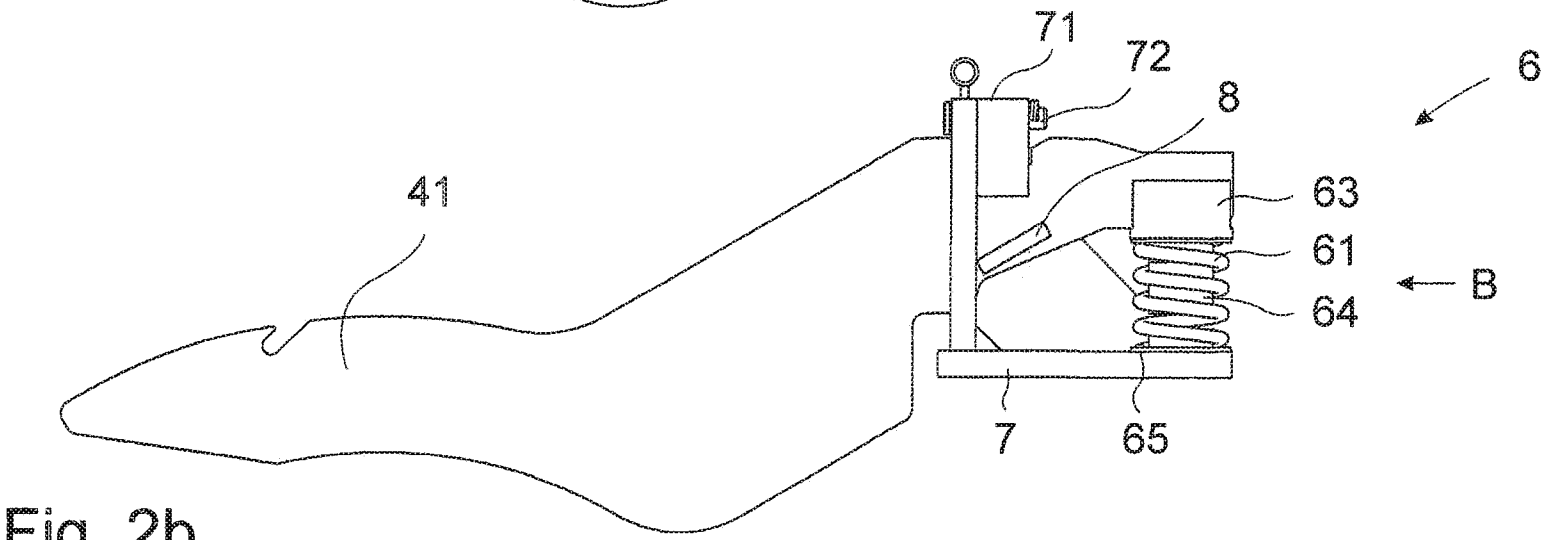

FIGS. 2*a* and 2*b* show the solution according to the invention. This is confined to a lateral representation of a screening element 41 and the suspension 6. The suspension 6 is marked schematically with an arrow. According to the invention, the suspension 6 consists of the compression spring 61. This is configured as a spiral spring. The compression spring 61 comprises end disks 65 at its end faces, having fastening features at their ends (not shown in detail). The compression spring 61 can be arranged at least partly in a spring sleeve 63. The suspension 6 has an end position limit B. This also is denoted only schematically by an arrow. The preferred solution according to the invention is characterized in that the suspension 6 is formed by at least one compression spring 61 fashioned as a spiral spring, in whose core at least one cylindrical body 64 is arranged. According to the representation in FIGS. 2*a* and 2*b*, the cylindrical body 64 extends only across a portion of the internal spring distance of the compression spring 61. This design solution, however, should not be understood as being a limitation of the invention. Instead, the solution according to the invention also encompasses a variant in which the entire spring distance of the compression spring is filled up by this cylindrical body 64. The cylindrical body 64 consists of an elastic material having a progressive characteristic curve of pressure and distance. It is advantageous for the cylindrical body 64 to correspond in its outer diameter to the inner diameter of the compression spring 61. This should likewise not be understood in a limiting sense. Instead, the cylindrical body may also be arranged with play in the compression spring 61. The mounting 7 according to the invention is somewhat different in design from that of the prior art. Thus, it is configured as a right angle, wherein the compression spring 61 is arranged on one leg of the right angle and a locking piece 71 on the other leg, which can be secured by means of a fastening element 72 to the mounting 7. This is configured either as a fork or as an angle element at least on the side of the mounting 7 facing toward the locking piece 71. The screening element 41 is grasped by the "fork" of the locking piece 71 on the side facing toward the mounting 7 or at least secured at one side by the angle of the locking piece 71. On the side of the mounting 7 there are provided flat iron pieces 8, which guide the rear-pointing leg of the screening element 41 to the side. These flat iron pieces 8 may be beveled on the side toward the leg of the screening element 41, so that a lateral movement is allowed up to certain limits. In this way, a limited gimballed behavior of the screening elements 41 can be achieved.

Figure 2C:
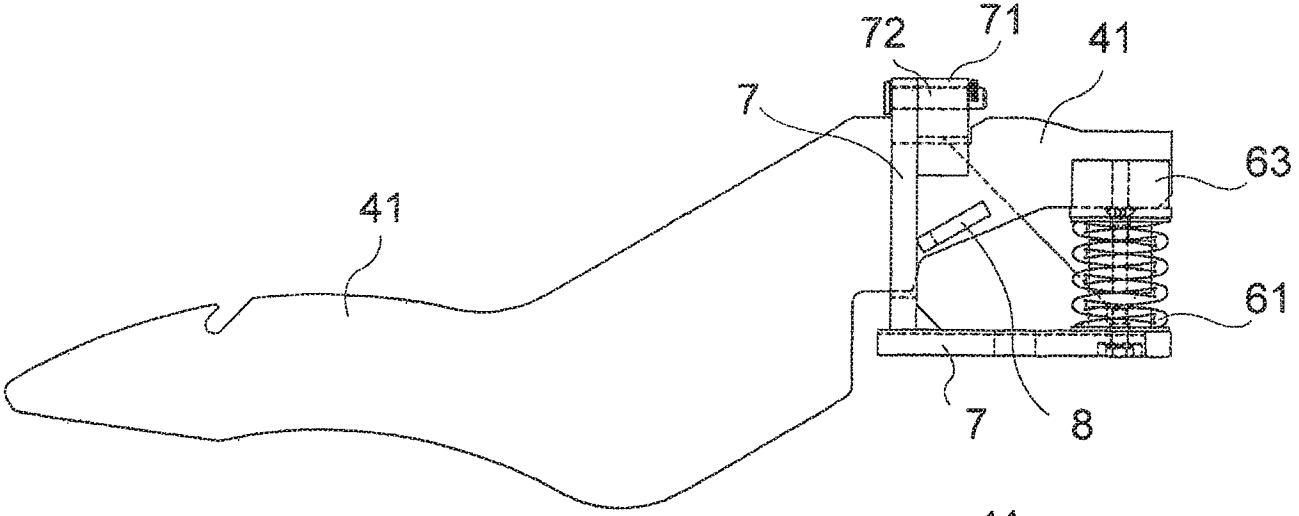
FIGS. 2*c*-2*d* show a representation of FIGS. 2*a* and 2*b* as a cross section and in three-dimensional view.
Figure 2D:
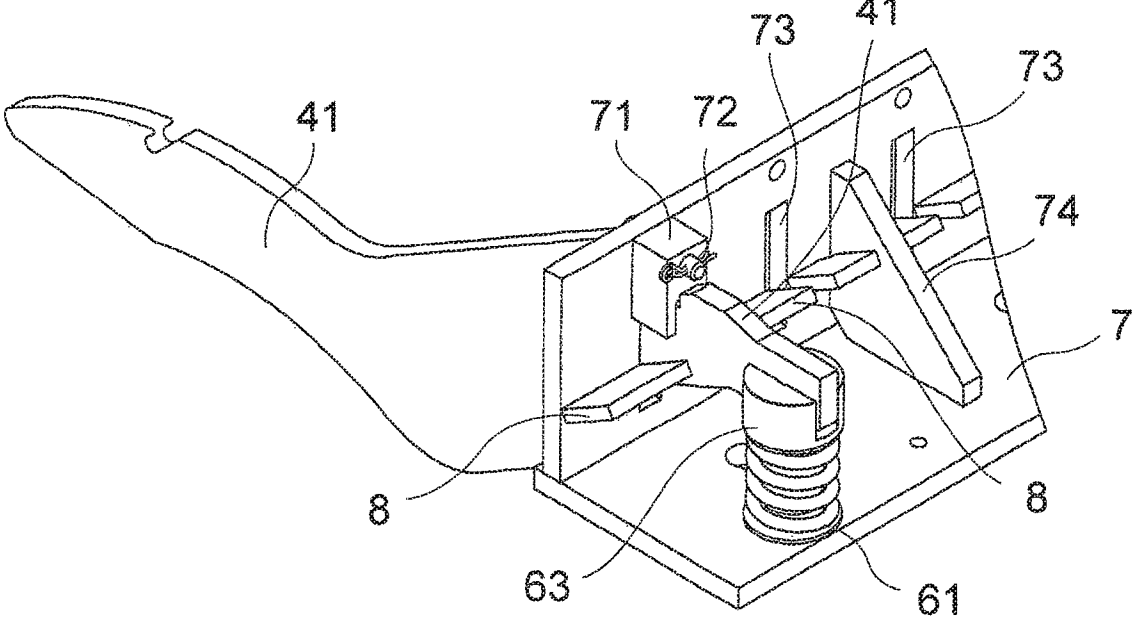

FIGS. 2*c* and 2*d* show the previously described solution of FIGS. 2*a* and 2*b*, but here as a side view in cross section in one case and as a three-dimensional representation in the other. In particular, it is evident from the three-dimensional representation that the locking piece 71 can be configured both as a fork and as an angle. In the fork configuration, the screening element 41 is enclosed on both sides, while in the angle configuration it is only braced on one side. One screening element 41 is secured on the mounting 7, while 2 further screening elements can be further mounted through the openings 73. The previously described flat iron pieces 8 form an additional, lateral guide for the screening elements 41. The fastening means 72 provided here is a bolt, which is secured by a cotter pin. A stiffening plate 74 strengthens the mounting 7.

The invention has previously been described with the aid of an exemplary embodiment. However, the invention is not limited to this. The claims now and later submitted with the application are attempts at a wording without detriment to the achievement of a further protection.

The references mentioned in the dependent claims point to the further configuration of the object of the main claim by the features of the respective dependent claim. However, these should not be understood as being a renunciation of the achievement of an independent, substantive protection for the features of the dependent claims being referred to.

Features which have thus far been disclosed only in the description may be claimed in the course of the proceeding as being of important inventive significance, for example to distinguish them from the prior art.

The invention claimed is:

1. A crushing device with a comb system, wherein the crushing device includes at least one crushing roller rotatably mounted in a machine frame with at least one crushing tool arranged thereon, wherein the crushing device comprises at least one counter blade which cooperates with the crushing tool, wherein the comb system comprises at least one base comb on which the at least one counter blade is arranged and on which at least one screening element is arranged as a component of a screening device, wherein the screening device at least partly encloses the at least one crushing roller and the at least one screening element is spring-mounted with a suspension on a base comb, wherein the suspension is formed from at least one spiral compression spring, in a core of which at least one cylindrical body made from an elastic material is arranged, where an external diameter of the at least one cylindrical body corresponds to an internal diameter of the spiral compression spring.

2. The crushing device according to claim 1, wherein the elastic material is an elastomer with a progressive characteristic curve of pressure and distance.

3. The crushing device according to claim 1, wherein the at least one cylindrical body extends across only a portion of the internal spring distance and the at least cylindrical body is an end position limit or end position buffer for the compression spring.

4. The crushing device according claim 1, wherein the elastic material is an elastomer with a hardness between 60 to 120 Shore.

5. The crushing device according to claim 1, wherein the at least one cylindrical body has a central through bore serving as a further parameter for setting a specific suspension behavior.

6. The crushing device according to claim 1, wherein a mounting is provided on which the screening element is pivot-mounted, the screen element pivoting in two different directions as a gimballed mount.

7. The crushing device according to claim 6, wherein a locking piece is provided to secure the screening element, wherein the locking piece is fastened by a fastening element on the mounting.

8. The crushing device according to claim 6, wherein flat iron pieces are provided laterally on the mounting which guide the rear-pointing leg of the screening element laterally.

9. The crushing device according to claim 8, wherein the flat iron pieces are beveled laterally on a side facing a leg of the screening element to allow a lateral movement up to certain limits.

10. The crushing device according to claim 6, wherein a replaceable seat is provided on the base comb, on which the mounting, the suspension and the screening element are exchangeably arranged.

11. The crushing device according to claim 10, wherein a plurality of screening elements are arranged on the seat and the screening elements are provided as a collectively mountable/dismountable assembly with the seat.

12. The crushing device according to claim 1, wherein, one or more of: the compression spring has end disks with fastening features at the ends, and the compression spring is arranged at least partly in a spring sleeve.

13. The crushing device according to claim 1, wherein the suspension comprises an adjusting device to allow one or more of a preloading force of the compression spring and an attack angle ($\alpha$) of the screening element to be adjusted.

14. The crushing device according to claim 1, wherein a distance of the screening element from the crushing roller is adjustable.

15. The crushing device according to claim 1, wherein the screening device is shaped as a basket and individual screening elements form the basket, which encloses the crushing roller in the lower region in its erect position, such that the position of the crushing roller and the screening device in the device is oriented substantially horizontally.

16. The crushing device according to claim 1, wherein the cylindrical body extends across the entire internal spring distance of the compression spring, such that the cylindrical body is one or more of an end position limit and end position buffer for the compression spring.

17. The crushing device according to claim 1, wherein a mounting is configured as a right angle, formed in a shape of a fork at least on a side facing the screening element, to enclose the screening element.

18. The crushing device according to claim 1, further comprising a pivoting device configured to allow the base comb to pivot about an axis.

* * * * *